US009873950B1

(12) United States Patent
Koszewski

(10) Patent No.: US 9,873,950 B1
(45) Date of Patent: Jan. 23, 2018

(54) METHOD AND APPARATUS FOR CATHODICALLY PROTECTING A STORAGE TANK

(71) Applicant: Louis Koszewski, Oak Brook, IL (US)

(72) Inventor: Louis Koszewski, Oak Brook, IL (US)

( * ) Notice: Subject to any disclaimer, the term of this patent is extended or adjusted under 35 U.S.C. 154(b) by 542 days.

(21) Appl. No.: 13/999,333

(22) Filed: Feb. 12, 2014

Related U.S. Application Data

(62) Division of application No. 12/288,387, filed on Oct. 20, 2008, now abandoned.

(51) Int. Cl.
*B65D 90/02* (2006.01)
*C23F 13/02* (2006.01)

(52) U.S. Cl.
CPC ..... *C23F 13/02* (2013.01)

(58) Field of Classification Search
CPC ..... C23F 13/02
See application file for complete search history.

(56) References Cited

U.S. PATENT DOCUMENTS

| | | | |
|---|---|---|---|
| 2,223,713 | A | 12/1940 | Zigler |
| 5,065,893 | A | 11/1991 | Kroon |
| 5,375,733 | A | 12/1994 | Kohler |
| 5,397,103 | A | 3/1995 | Watson |
| 6,224,743 | B1 | 5/2001 | Satyanarayana |
| 6,431,387 | B2 | 8/2002 | Piehler |
| 7,344,046 | B1 | 3/2008 | Larson et al. |

OTHER PUBLICATIONS

Cathodic Protection of Above Ground Storage Tanks in an Arctic Environment, Tom Barletta, Rich Bayle, Kevin Kennelley, Paper No. 352, May 1996.
Declaration of Tor Larson dated Mar. 16, 2013.
Declaration of Tom Barletta dated Apr. 8, 2013.
Second Declaration of Tom Barletta dated Feb. 12, 2014.
Declaration of Louis Koszewski dated Feb. 14, 2014.
Guidelines and Methods for Inspection of Existing Atmospheric and Low-pressure Storage Tanks, Second Edition, May 2005.
Cathodic Protection of Aboveground Petroleum Storage Tanks, Second Edition, Nov. 1997 (Prior Art).
Cathodic Protection of Aboveground Petroleum Storage Tanks, Third Edition, Jan. 2007 (Believed Not Prior Art as not a year before filed of Provisional Application).
NACE International, p. 3, 2001 (Prior Art).

*Primary Examiner* — Ryan J Walters
(74) *Attorney, Agent, or Firm* — Pyle & Piontek, LLC

(57) ABSTRACT

A method and apparatus are disclosed for providing a new or second bottom in a new or existing storage tank that is spaced above or electrically isolated from the first or old bottom. The tank's sidewall may be separated or slit open, new bottom forming plates slid in place to form the new or second bottom, and the sidewall's upper and lower portions held apart by say spacers, blocks, channels or special fill to electrically insulate or isolate the upper bottom from the lower bottom and protect the new, upper bottom from corrosion. As noted, the present invention may also be used with an existing single or new or existing double or more bottom tanks and with existing or new cathodic protection and other tank construction technology such as lightning and/or static or electrical grounding.

44 Claims, 21 Drawing Sheets

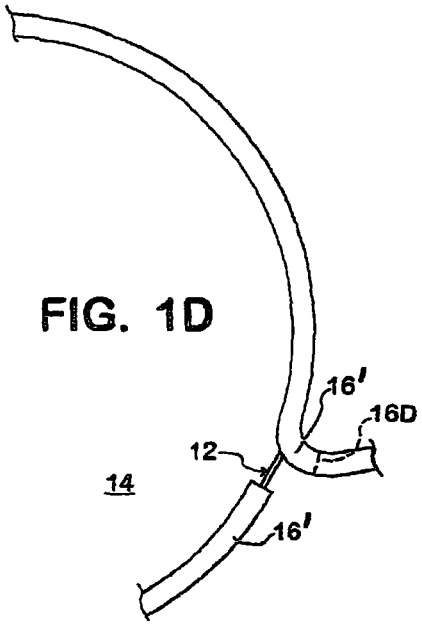
FIG. 1D
FIG. 1E
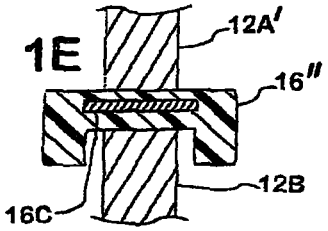
FIG. 1F
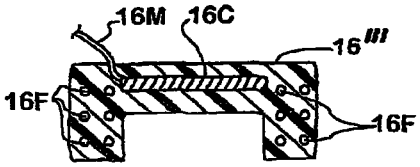
FIG. 1G
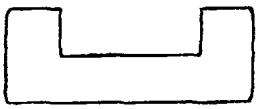
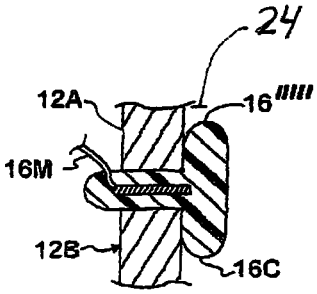
FIG. 1I
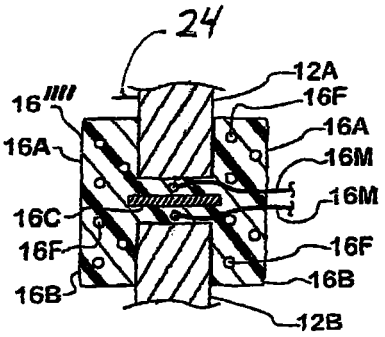
FIG. 1H FIG. 14
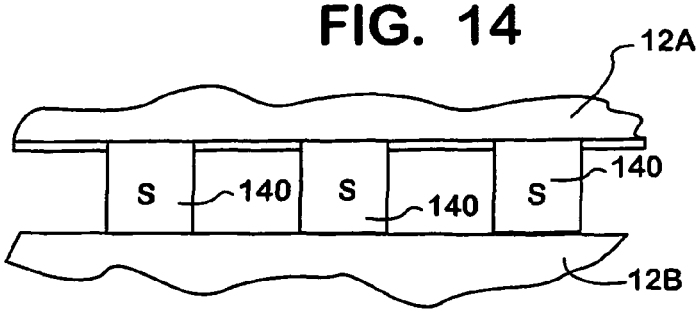
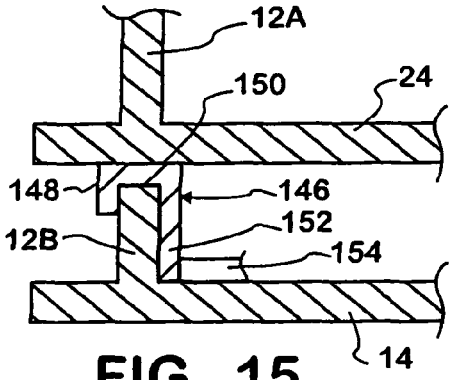
FIG. 15
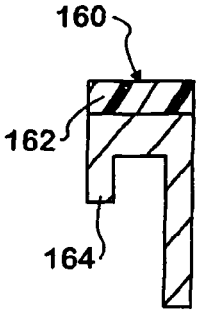
FIG. 17
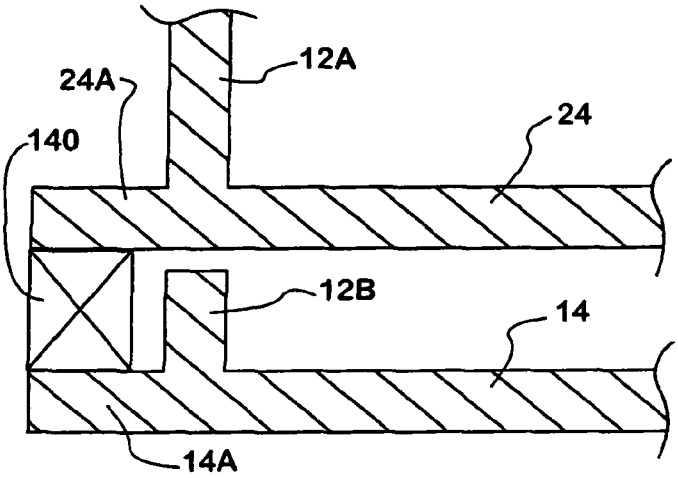
FIG. 16
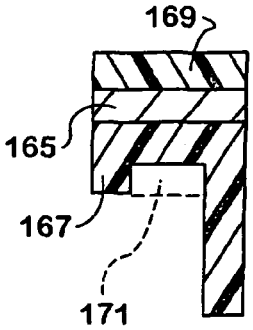
FIG. 17A

METHOD AND APPARATUS FOR CATHODICALLY PROTECTING A STORAGE TANK

DISCLOSURE

This application is a United States Non-Provisional, Divisional Application, and if necessary a Continuation Application and claims the benefit and priority of U.S. NonProvisional application Ser. No. 12/288,387, filed Oct. 20, 2008 (the 18th being a Saturday, 37 C.F.R. 1.7), U.S. Provisional Application Ser. No. 60/999,495 filed Oct. 18, 2007, both of which are incorporated herein by reference, of the same title, and relates to a method and apparatus for protecting storage tanks from corrosion, and more particularly, for protecting a new tank bottom added to an existing or new storage tank.

BACKGROUND OF THE INVENTION

Metal tanks, usually made of steel, have been used to store various fluids, gases and liquids, such as for example, but not limited to, gases, water, chemicals and petroleum products, such as crude oil, fuel oil, diesel fuel and gasoline. The tank has a sidewall, usually but not necessarily circular, a top usually attached to the sidewall at the top, and a bottom wall connected to or near the bottom of the sidewall. Some of the tanks are placed on foundations, while others are built on the ground. Corrosion has been a problem with the tanks, and corrosion can result in leakage. Generally, leakage must be contained or better yet prevented. Various techniques have been used to prevent corrosion. One of the more popular ones is to provide anode-cathode protection to the tanks, and particularly, the tank bottoms. Even with such protection a tank bottom can corrode, and with the passage of years, say 10 to 20, in order to extend the tank's life, a new or second bottom is provided for the tank. Previously the usual approach was to reconstruct the existing tank to provide a second or new bottom a foot or less above the corroded, original tank bottom. The new bottom was secured or welded to the existing sidewall. The old, corroded bottom in effect was still electrically in contact or connected to the sidewall, and the sidewall was connected to the new bottom wall. Thus, the old bottom tended to prevent the cathodic protective current from protecting the new bottom, as the old bottom shielded the new bottom from such protective current flow.

BRIEF SUMMARY OF THE INVENTION

In the method and apparatus of the present invention, the tank, such as an existing tank with an existing tank bottom is opened up to the extent that all or a portion of the sidewall is electrically separated from the old bottom. One way to do this would be to separate the sidewall, say a foot or less above the old bottom from the old bottom. This separation could be achieved in various ways as by driving wedges into the tank to separate it or, if need be, slot or cut into the tank to separate the two portions of the sidewall. Once separated, slotted or cut apart, the tanks upper and lower portions could also be separated or held permanently or temporarily apart by various other means, such as jacks (mechanical or hydraulic), air bags or even floated off the ground by flooding with water, use of a crane or cranes, and/or levers. When separated, the tank or the sidewall's upper and lower portions are then permanently held apart, such as by insulating spacers, blocks, fill, jacks, legs, braces, air bags or other means to provide a space or gap etc., which will be more fully described below. Of course, the rest of the tank could alternatively be separated from the old bottom. These spacers and blocks could be made of fiberglass, non-conductive carbon, neoprene, phenolic material, teflon and/or various rubbers, such as a silicone rubber. While the fill if used could be highly electrically resistant material, such as sand, clay, limestone, granite, crushed granite, fine rocks, gravel, asphalt, pea gravel, clam shells, concrete, or other materials with similar resistive characteristics or even air itself or even a vacuum. Whatever material is used must be compatible with and not attacked by the material or materials to be stored or put into the tank. The old bottom may or may not be cut out in the center. The nonconductive or highly resistive fill may be provided in the center of the tank above the old floor or bottom or where the old floor or bottom was. Such fill could be used with or in lieu of isolating blocks or spacers. Then the new tank bottom is built over the fill and connected to the sidewall upper portion or upper part of the tank, as by welding. Since the old bottom (and any connected part of the sidewall) or whatever is left over from the old bottom (and sidewall) is electrically not in contact with but is electrically isolated from the upper sidewall and the new bottom, it is seen just as part of the earth or ground, and does not defeat the cathodic protective current flow. As noted above, on an existing double bottom tank, one method would be to drive wedges, use jacks, water floatation or, use air bags to separate the portions of the lower sidewall from the original or primary tank bottom. Also the material to form the new bottom could also be inserted into the separation, cut or slot and then assembled as by welding. Spacers, blocks, fill, etc. could be inserted around the perimeter or circumference to provide the electrical isolation. The spacer and blocks need not cover the entire tank perimeter, but just a sufficient portion, with a sufficient number of the same to well support the tank on ground, lower sidewall and/or old bottom.

While described above in conjunction with adding a new bottom to an existing tank, the invention can also be applied to use in existing or new double bottom constructed tanks, wherein the upper bottom and lower bottom are electrically isolated. The invention could also be used in adding a new bottom to a double bottom tank to form a triple bottom tank.

On an existing or a completely new double bottom tank construction for example, the spacers would be added between the secondary tank bottom and the primary tank bottom during the construction of the tank. A conductive RPB (liner) may or may not be used with any of the above-described tanks. Lightning protection, sealing against weather or moisture and tank centering or locating means may be incorporated into the tank or spacers therefor, if needed or desired.

An advantage of the method and apparatus of the present invention is that it can be installed on an "In Service" tank and/or on an "Out Of Service" tank. That is, the tank need not be taken "Out of Service" when installing the invention. As used herein, "In Service" tank is a tank that is in active service and contains product stored therein. As used herein an "Out Of Service" tank is a tank that has been drained, usually internally cleaned, and has no product going in or out of the tank. Of course, in the former, the containment of the tank would not be broken and the tank not say slotted above its containing bottom.

As used herein "fill" is a tank pad and/or the material between tank bottoms. Fill normally would be sand, but is not limited to sand and could include other materials, such as those disclosed herein, including rock and/or soil or a combination of such materials.

An object of the present invention is to prevent electron movement as permitted by metal to metal contact between the old corroded structure (bottom) and the remaining or new structure (including new bottom). Electron movement as in metal to metal contact is distinguished from ionic flow in an electrolyte. As the ions are relatively heavy and slow moving electrolytes have much more higher resistivities than metals. Thus, electron flow as in metal to metal contact is much more conductive and much less resistive than would a flow permitted in an electrolyte, such as is found in the ground beneath a tank. Flow in an electrolyte is what is utilized in cathodic and anodic protection systems to prevent or reduce corrosion and is thus necessarily present with such systems.

DESCRIPTION OF THE DRAWINGS

FIG. 1D is a schematic showing how a flexible isolator, or spacer insulator, can be taken off of a roll (not shown) and applied continuously to the tank and is cut to length as needed to fit the tank or sidewall;

FIG. 1E is a cross-section of a portion of the tank sidewall and a "c" or a channel shaped spacer or isolator, which could be like shown in FIG. 1B or FIG. 1D, with a steel insert segment and made of heavy duty rubber, similar to an automotive tire;

FIG. 1F is a view similar to FIG. 1E but showing in addition strength cords of synthetic, natural materials or steel;

FIG. 1G is an isolator that could be similar to shown in all the previous figures but turned upward;

FIG. 1H is an "H" section profile isolator, insulator or spacer that has two sets of upper and lower sealing lips to engage and locate the seal and tank and keep out weather, and the reinforcing piece and cords and monitoring cords wires;

FIG. 1I is a T-shaped insulator, isolator or spacer that could be fitted from the inside or outside of the tank and could be provided on a roll as could any of the others, and cut to lengths as needed;

FIG. 14 is a schematic view showing a series of spacers "s" holding the sidewall portions apart;

FIG. 15 is a schematic view showing a specially formed spacer;

FIG. 16 is a schematic view showing one of a series of spacers holding the sidewall like FIG. 14;

FIG. 17 is a schematic showing a special formed laminated spacer/seal;

FIG. 17A is a schematic of a second form of special laminated spacer having one or more seals;

DESCRIPTION OF THE PREFERRED EMBODIMENTS

Figure 1A:
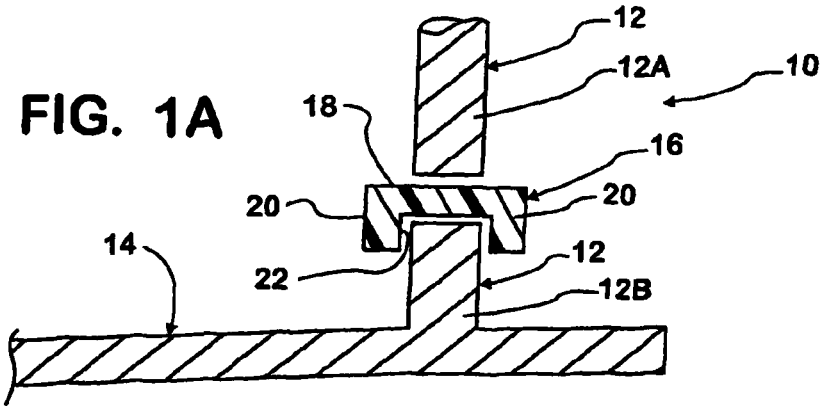
FIG. 1A is an enlarged, schematic, cross-sectional view of a first method and apparatus for isolating a sidewall of a tank from its existing tank bottom, and is taken on the line 1A-1A of FIG. 1B.
Figure 1B:
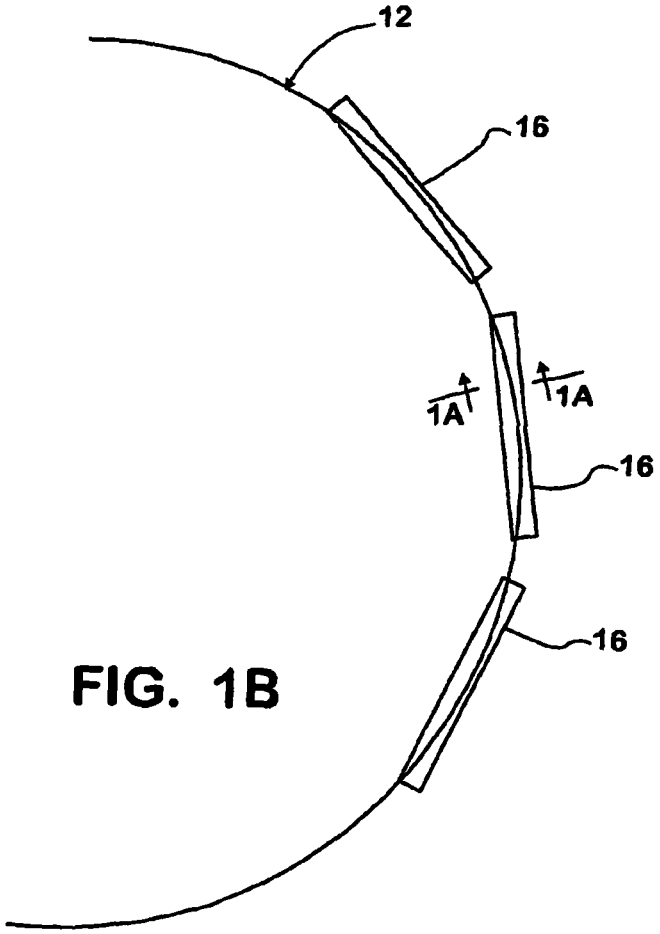
FIG. 1B is a schematic view of the tank shown in FIG. 1A, with a plurality of such channels cut and spaced around the perimeter of the sidewall to support and isolate the upper part of the tank.

Referring to FIG. 1A, a cross-sectional view of a portion of a tank 10 is shown. The tank has a sidewall 12 now formed in an upper portion 12A and a lower portion 12B. The lower portion 12B is joined to the tank bottom 14. As shown the sidewall 12 was separated, cut, slotted or split, for example, in a manner described above, to form the upper and lower portions 12A and 12B. A channel shaped spacer insulator or isolator 16, say made of fiberglass or other suitable electrically insulating material, is provided between the upper and lower portions 12A and 12B. The web 18 of channels 16 is sufficiently wide to permit it to engage the sidewall 12B of the tank along a considerable arc, say 5 to 10 degrees of its perimeter. It should be understood as shown in FIG. 1B a plurality of such channels or isolators 16 would be provided and spaced along the entire perimeter of the tank. The end protrusions 20 of the channel 16 hold it in place. The channel opening 22 could face either up or down, but for an outside tank facing down is favored as it will not collect rain.

Figure 1C:
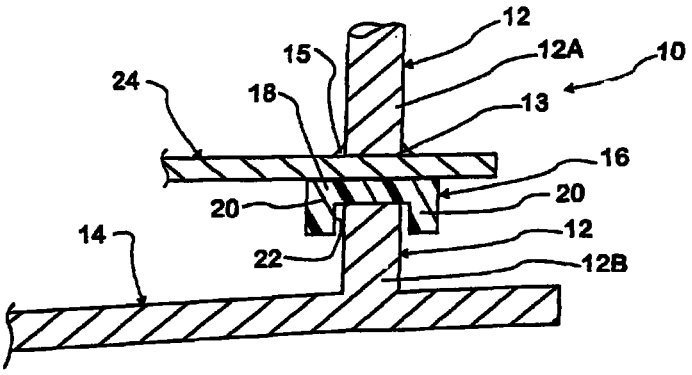
FIG. 1C is similar to the tank shown in FIGS. 1A and 1B, but shows the second or upper bottom having been added.

FIG. 1C shows how a second bottom 24 above the first bottom 14 may be provided to provide a double bottom storage tank. The tank 10 could be either an existing single bottom tank to which a new upper bottom is added or, a double bottom tank of existing or new construction. The new bottom is welded to the sidewall as indicated at 13 and 15.

Now the isolator 16' could also be curved to fit the curvature of the round tank as which it would be used, see FIG. 1D. Also the isolator can be made in sets to fit a range of curvatures, say tanks of a range of diameters. For example, there could be one isolator to fit tank size from 10 to 12 feet in radius, and another isolator to fit the next tank sizes say 12 plus feet to 15 feet in radius, with others to fit tanks smaller and others to fit tanks larger. Thus, the isolator would need to accommodate only a range of tanks radius, and not the complete range, which could be small, 10 or smaller feet and as large as 400 or larger feet in diameter. Further, the isolator could be made flexible with a construction of a suitable material and say capable of fitting on a tank or its separated sidewall as small as the above, but to as long as possible. This type isolator could be constructed of rubber similar to that like used in tires. To give such isolator strength it could include strength elements like cords 16F, both of synthetic material as in tires, kevlar, aramid, carbon fibers, or metallic, as steel or composite with both synthetics and steel. For example, an "H" shaped rubber isolator 16"" could have sets of vertical lips 16B to seal with the tank sidewalls 12A and 12B to hold the isolator in place and/or keep out weather. These lips could be either on the upper sidewall (giving a "u" or "c" shaped isolator with the opening facing upward) or on the lower sidewall (giving a similar "u" or "c" shape but with the opening facing downward, see FIGS. 1E and 1F), or both (giving an "H" shaped isolator 16"" with opening for both the upper and lower sidewall, see FIG. 1H). Of course, other shapes could be used, such as a "T" on its side (see FIG. 1I) with the top of the "T" extending along between the two upper and lower sidewalls 12A and 12B to help locate and seal against weather. The cross piece of the "T" could be inside or outside the tank sidewall and the other leg between the sidewalls to hold it in place and separated. Other suitable shapes could be "L" and "V." The portion between the sidewalls holding this or other isolators could have imbedded therein short steel or other material segments 16C capable of being bent around the tank circumference of various radii (say from 10 to 400 feet or greater), but isolated by the rubber. The purpose of these steel or other segments would be to help hold the tank portions apart without bridging the electrical isolation. Such steel or holding apart segments would be located in say the center of the "H" and the center of the "c" or "u" and/or in the portions that are to be between the separated upper and lower portions of the tank or it sidewall(s). Of course, a spacer like 16"" could be provided with only a set of upper or lower lips.

Further, if steel or conductive elements 16C or wires 16M, see FIGS. 1F, 1H and are imbedded in the isolator on their upper and lower portions or in the center of the tank separator, they could, via the wire 16M be monitored to determine if and when there was a breach or at least a partial breach of the isolation provided by the spacer.

Figure 1J:
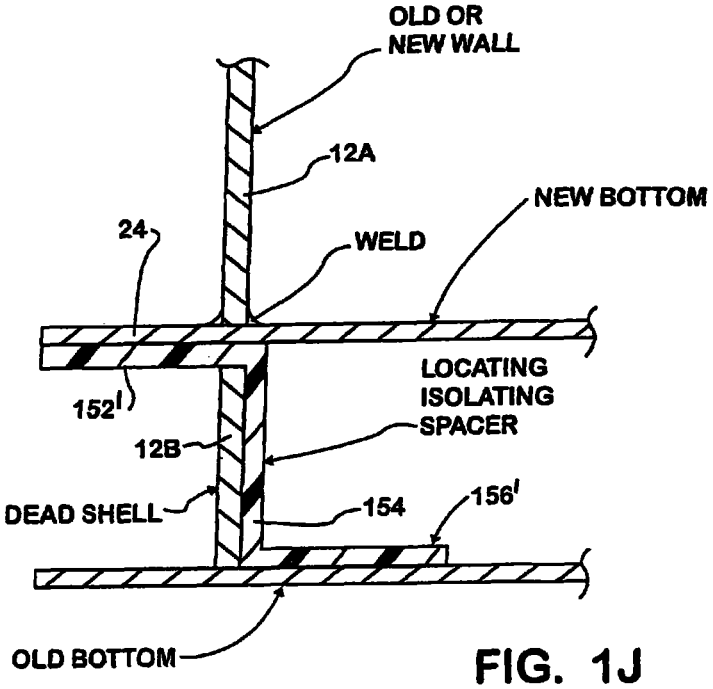
FIG. 1J is another alternative embodiment of insulator, isolator or spacer.

Now this type isolator (16' to 16"") could be generally continuous or as continuous as desired on the perimeter of the tank. The isolator 16' to 16"" could be provided on a roll for ease of installation and then cut to the length needed (as indicated by dotted line 16D). For example, a single piece could be used that would extend around generally the entire tank circumference or perimeter back toward itself, leaving generally but one joint, which could be easily sealed. Of course, if need be this type joint could be applied in as many segments as desired, but generally the longer the segment and the fewer the pieces, the better. FIG. 1J shows a spacer somewhat similar to the spacer shown in FIG. 18 and is a spacer 152 having a horizontal leg 152' connecting to a lower leg 154 and a lower horizontal 156'.

Figure 2:
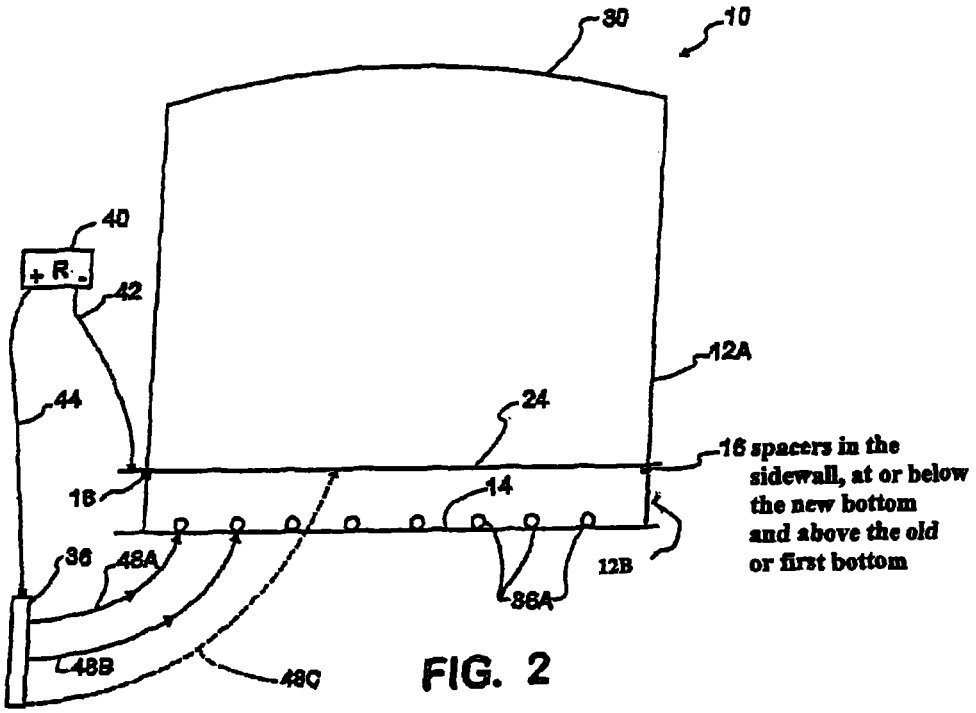
FIG. 2 is a schematic view of an existing or new tank, provided with a new or second bottom over the old or first bottom and spacers in the sidewall, at or below the new bottom and above the old or first bottom to isolate the new or second bottom from the old or first bottom, in this instance, showing an optional anode.
Figure 2A:
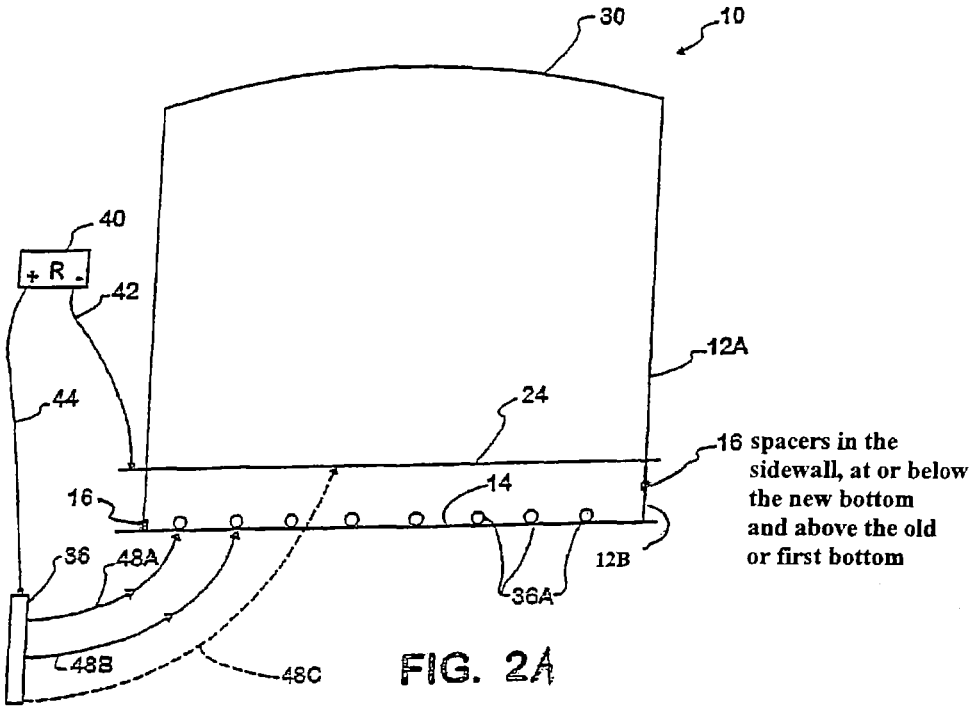
FIG. 2A is a schematic, nearly identical to FIG. 2, but illustrating the insulating/isolating 16 can occur anywhere at or above the existing bottom 14 and the new bottom 24, on the left side it being in between the bottom and on the right side it being at the bottom, while in FIG. 2 it being at the top.

Referring to FIGS. 2 and 2A, a similar tank 10 is shown and has the components described above, including a top 30. Existing anodes 36A may or may not be present between tank bottoms 14 and 24. Also shown is how an existing or new cathodic system including an anode 36, rectifier 40 and resistive cable 42 and positive cable 44, can provide the protective current indicated by the arrows 48A, 48B and 48C. Without the present inventions and without said spacers 16, currents 48A and 48B would not reach the new tank bottom 24, but reach only the existing bottom 24. With the invention currents (48A, 48B and 48C) will reach the new tank bottom 24 when tank bottom 14 is electrically isolated from tank bottom 24 so that bottom 14 is seen merely as "earth".

Figure 3:
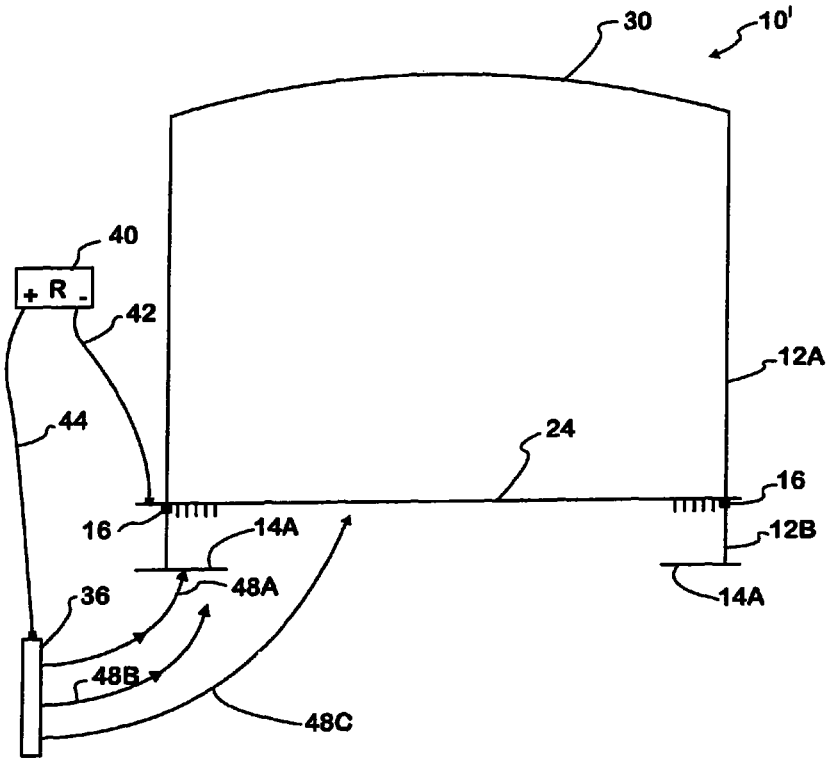
FIG. 3 is a schematic view of a tank similar to that shown in FIG. 2, but with the interior or center portions of the old bottom removed.

Referring to FIG. 3, tank 10' is similar to tank of FIG. 2, but shows the center of the old tank bottom 14 cut out, leaving only the shelf edges 14A.

Figure 4:
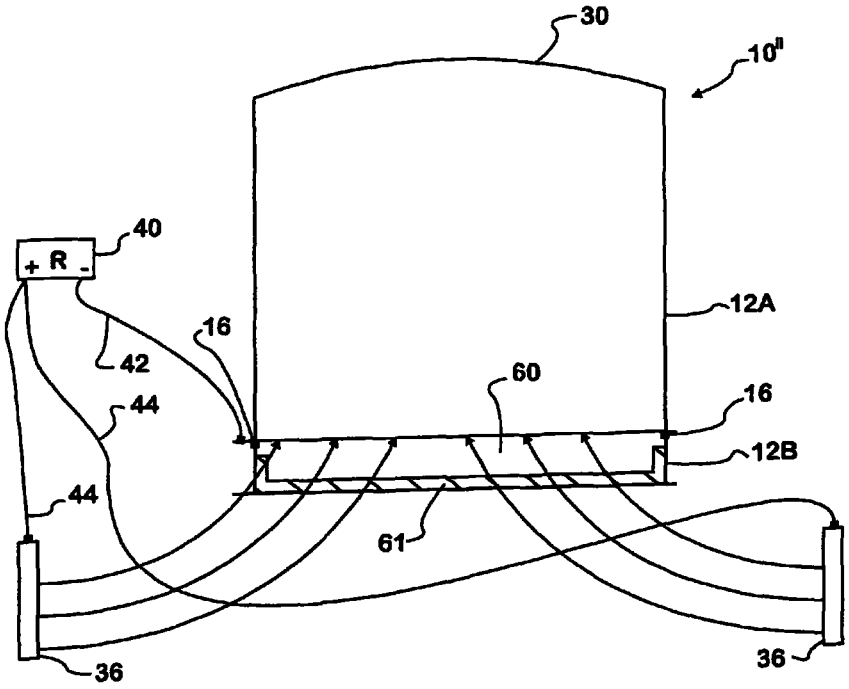
FIG. 4 is a schematic view of a tank similar to that shown in FIG. 2, but with a new conductive liner, such as clay, provided over the old bottom which has been left in place below the new bottom.

Referring to FIG. 4, tank 10" is similar to tank 10 FIG. 2, but with the old bottom filled with clean, dry highly resistive fill 60, such as sand or other fill described herein, and fitted with a new conductive release prevention barrier (RPB) or liner 61, such as clay, provided over the old or new tank bottom.

Figure 5:
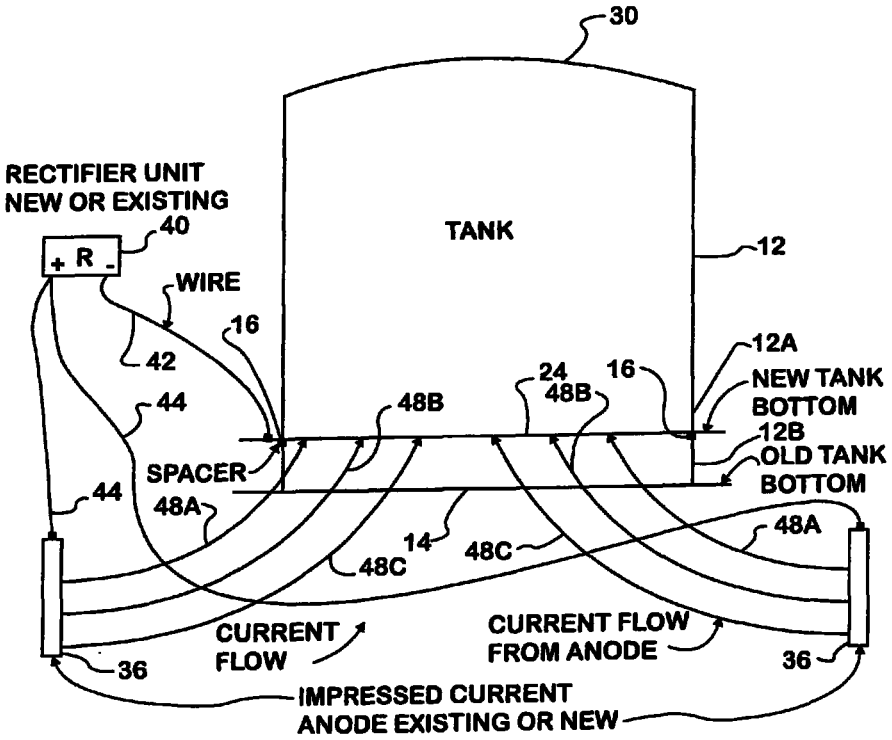
FIG. 5 is a schematic view of a tank similar to that shown in FIG. 2 but with no anodes between bottoms.

Referring to FIG. 5, it is like FIG. 2 but shows no anodes between the tank bottoms.

Figure 6:
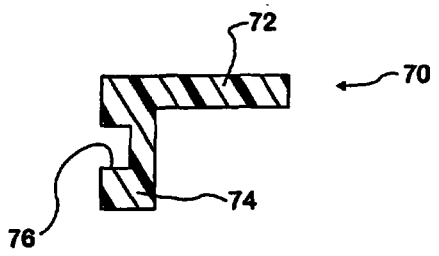
FIG. 6 is a greatly enlarged cross-sectional view of a spacer which can be held in place on the tank by banding.

Referring to FIG. 6, a special form of insulator or spacer 70 is shown, and it is generally "L" shaped having an upper leg 72 for separating and providing isolation between the upper and lower portions 12A and 12B of the tank sidewall. It also has a lower leg 74 having a recess or slot 76 for receiving a band to hold the insulation in place on the lower portion 12B of the sidewall 12, similar to that shown in the upper part of FIG. 13, except the band fits in the recess 76. Of course, the spacer could be inverted with the leg 74 above the portion 72 and then secured by the band to an appropriate sized upper sidewall portion 12A.

Figure 7:
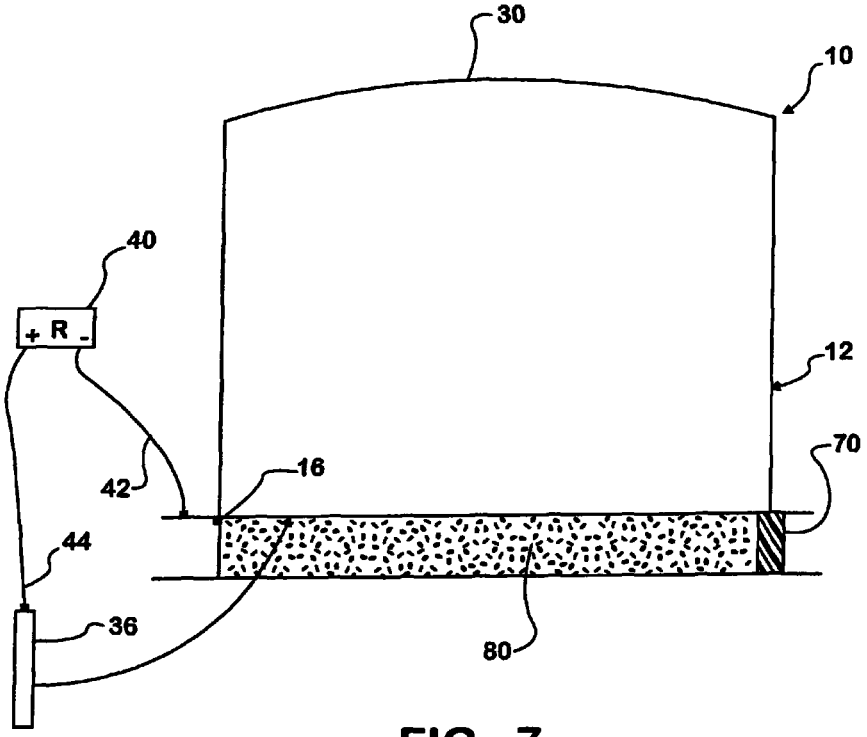
FIG. 7 is a schematic view similar to FIG. 2, but shows on the right, in the alternative, a block spacer to separate the old and new bottoms.

FIG. 7, illustrates a tank 10 and various ways of isolating the first and second bottoms such as the insulator 16, the insulating blocks 70, and/or the completely filled bottom 80, using, say concrete or other fill materials mentioned herein.

Figure 8:
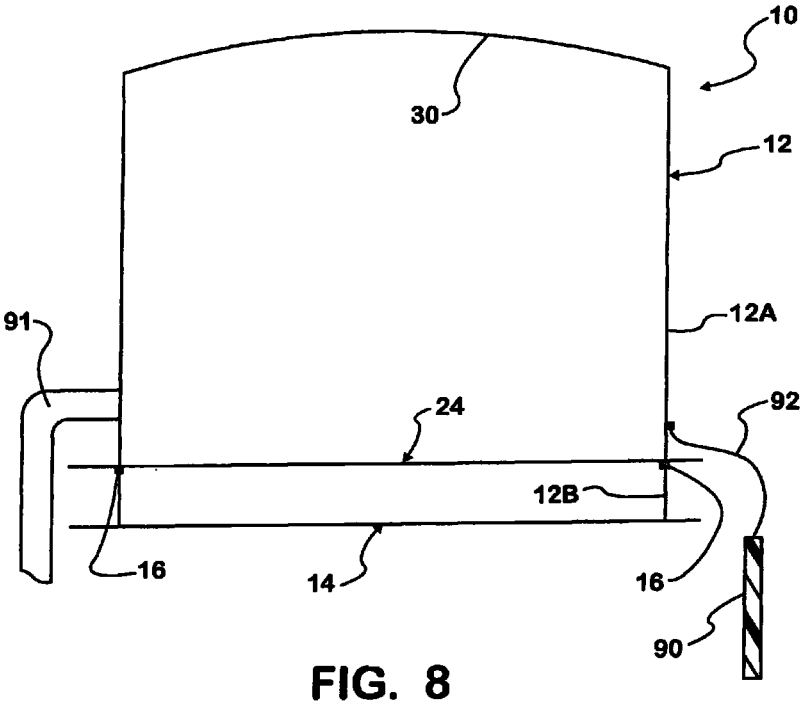
FIG. 8 is a schematic view showing ground rods for the tank sidewall and tank top.

Referring to FIG. 8, in addition to the present invention many tank owners prefer to have their tanks grounded, using a ground rod 90 and ground connector 92, connected to the upper portion of the tank 10, and its roof 30 and sidewall 12 for lightning protection. This same ground rod system can also be used to provide static charge protection and fault protection.

Also, if desired, as the upper portion of the tank is no longer directly connected to the ground through the lower portion of the tank, means for locating the upper portion of the tank relative to ground and/or lower portions of the tank can be provided, such as a separate structural element or legs 91 secured to the upper part of the tank and extending into the ground. Of course, piping into and from the tank and ladders on the tank may perform this locating function so that no separate locating element is needed.

Figure 9:
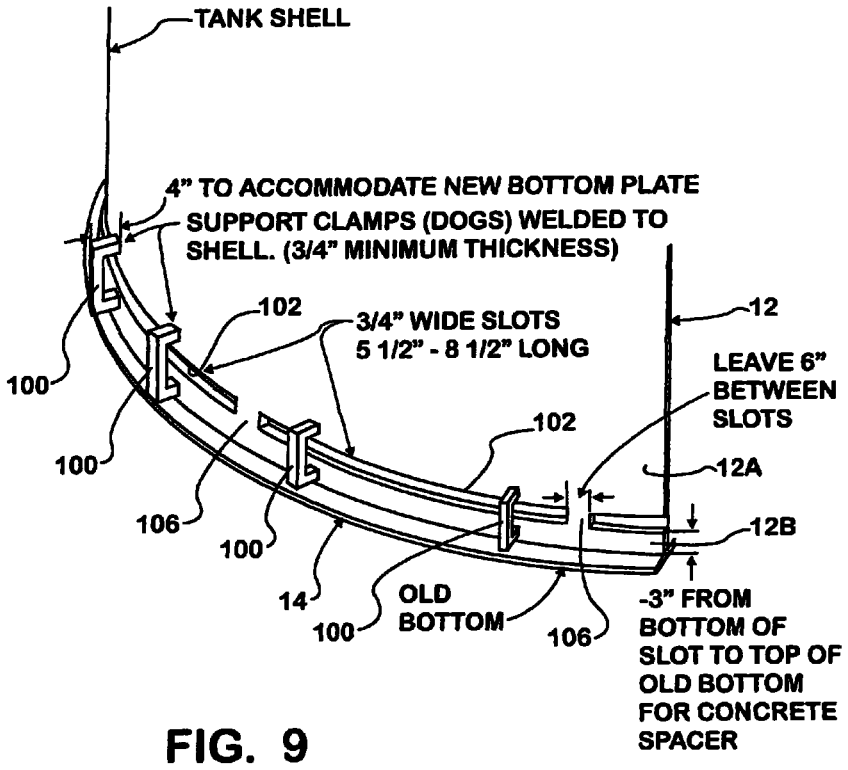
FIG. 9 is a perspective view of a portion of a tank showing how it may be slotted to permit plates to form the new bottom to be slid in place, while the tank sidewall is held spaced apart by temporary "c" sections welded to the upper and lower portions of the sidewalls; after the new bottom is in place and spaced or blocked apart from the old bottom, the remaining sidewall portions and temporary "c" sections can be removed and/or cut through and old and new bottoms kept isolated.

FIG. 9, illustrates one manner in which the existing tank can be fitted or reconstructed with a new bottom. A plurality of "c" shaped braces 100, say made of steel can be secured or welded to the sidewall 12, separating it into upper portion 12A and lower portion 12B. The intervening portions of the wall 12 may then be wedged apart, cut or slotted as indicated 102 to separate 12A from 12B. The new bottom may then be slid into the slots 102 and assembled and/or welded by workers on the inside of the empty tank to form the new bottom 24. It should be understood that the width of the slots or openings formed in the tank are wide enough to slip in, at least widthwise, the new steel sheet forming the new bottom. The insulator or isolator, be it 16, 70, 140, 146 and/or 160, etc., may be put in place to hold portions 12A and 12B of the sidewall apart. Then the remaining portions 106 of the sidewall can be cut away to isolate the upper sidewall 12A from the lower sidewall 12B. The "c" braces 100 would then be cut or removed to remove any current path through them. Of course, a simpler method would be to just separate or hold the two (upper and lower) portions of the tank apart with, say spaced wedges, and then just slip the isolators or insulators in place on the tank and/or between its sidewall portions 12A and 12B (See FIG. 2 and FIG. 2A).

Figure 9A:
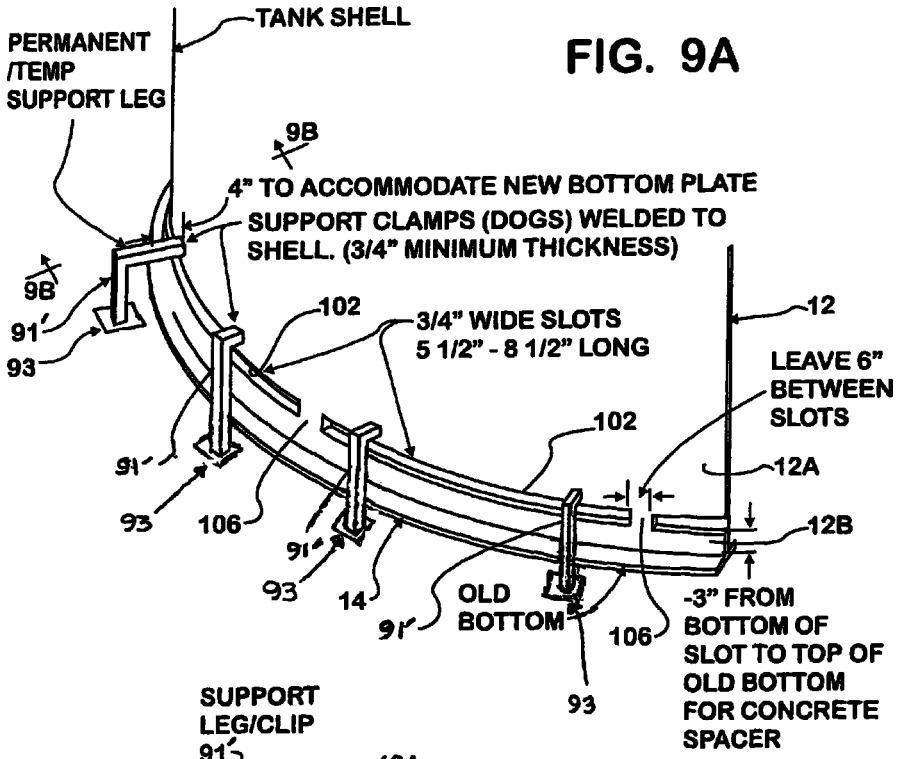
FIG. 9A is a view similar to that shown FIG. 9, but with the upper portion of the tank supported on legs to provide isolating gap or space.
Figure 9B:
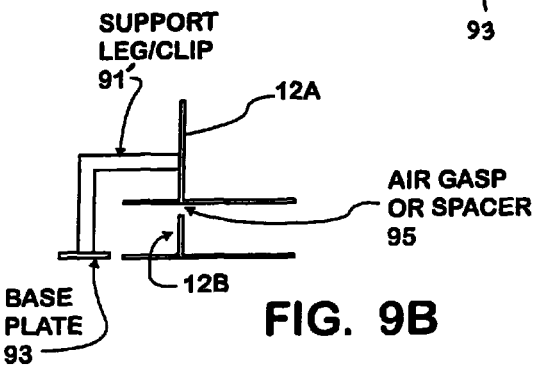
FIG. 9B is taken on line 9B-9B of FIG. 9A.

FIGS. 9A and 9B show alternative means for isolating the new bottom from the old bottom and that is to support the new bottom and upper portion of the tank over the old bottom with legs or even jacks. As shown in FIG. 9B, the leg 91' is attached to the sidewall 12A and rests on a base plate 93 on the ground, but provides an isolating air gap 95. Either the leg 91' or base plate 93 would be insulating.

Figure 10:
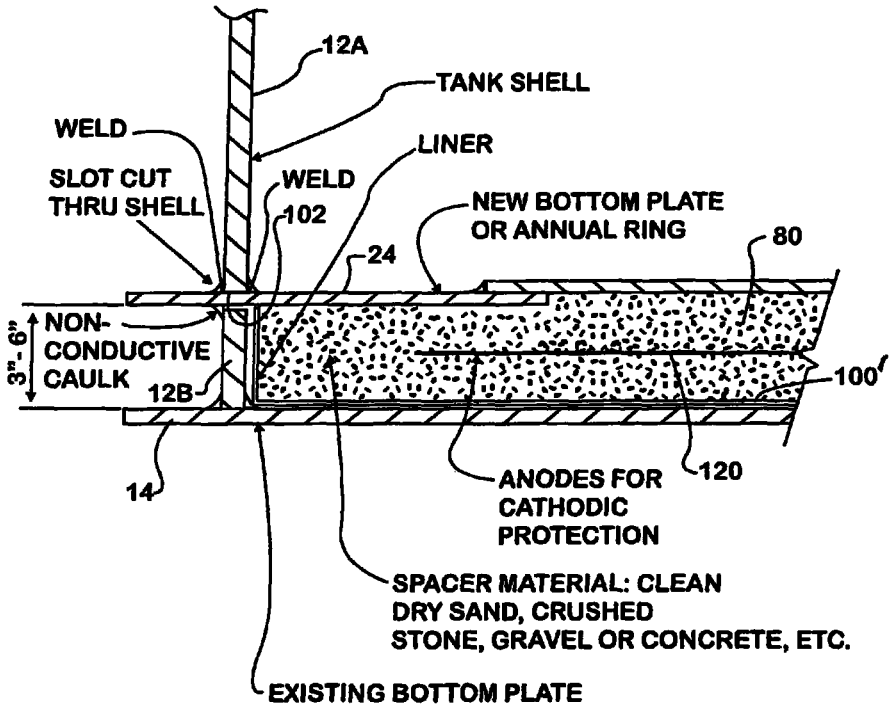
FIG. 10 is an enlarged cross-sectional schematic view of a tank having a slot in the sidewall with new or second bottom plates secured thereon and gapped and held spaced off the bottom by clean fill.

FIG. 10 is a cross-section showing how this new bottom may be provided. If desired, the clean fill 80 can be fitted with anodes 120, in the form of, for example, wires, ribbon, rods, ingots, mesh, slabs, etc. to protect the tank. A new bottom may be fitted with a conductive or nonconductive liner 100' underneath.

Figure 11:
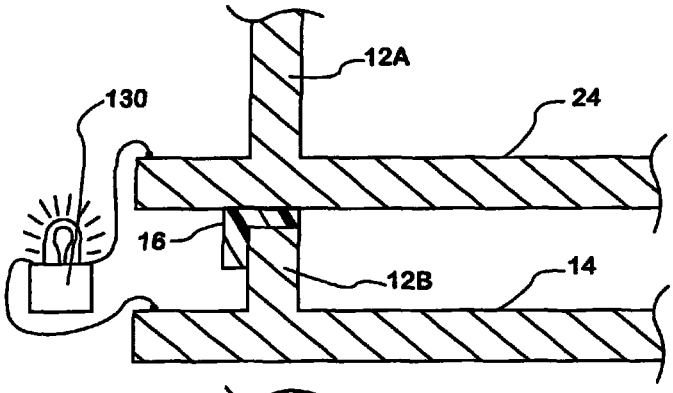
FIG. 11 is a schematic view of an angle cross-section spacer and showing a testor to test isolation and/or determine shorting.

FIG. 11, shows a spacer or isolator 16 in place and shows that the isolation provided can be tested during installation or subsequently with test gear 130, such as a flange isolation tester. This tester could be of the type further described below. During installation, the tank can be sufficiently separated so that the tester shows no electrical contact on its readout.

Figure 12:
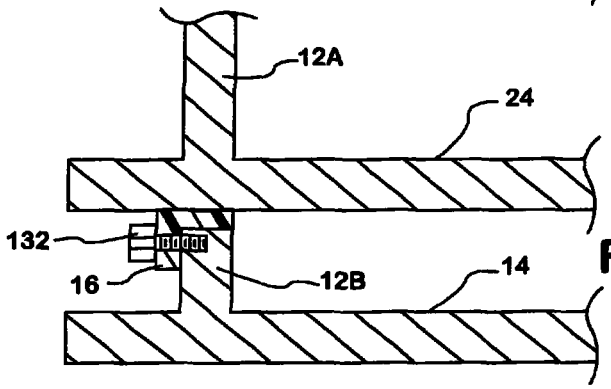
FIG. 12 is a schematic view of the spacer bolted in space.

FIG. 12, shows a similar shaped isolator 16, but it is held in place by fasteners 132, secured, in this instance, to 12B. The fastener openings may be tapped and/or the bolts or screws 132 may be self-tapping.

Figure 13:
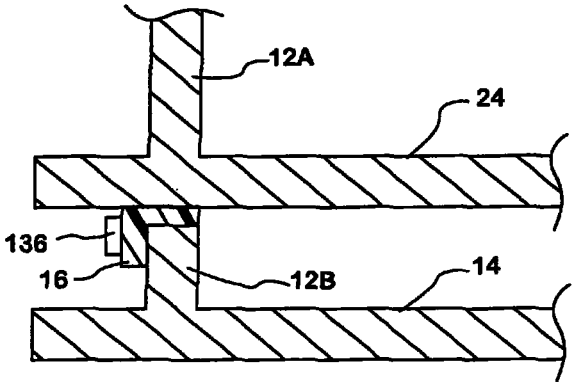
FIG. 13 is a schematic view showing the spacer held in place by banding.

FIG. 13, shows an isolator 16, held in place by a band 136, secured around the circumference or perimeter of the tank. The isolator could be similar to that shown in FIG. 6. It should be understood that the isolators or spacers can also be held in place by various means, such as adhesives or fasteners.

Figure 13A:
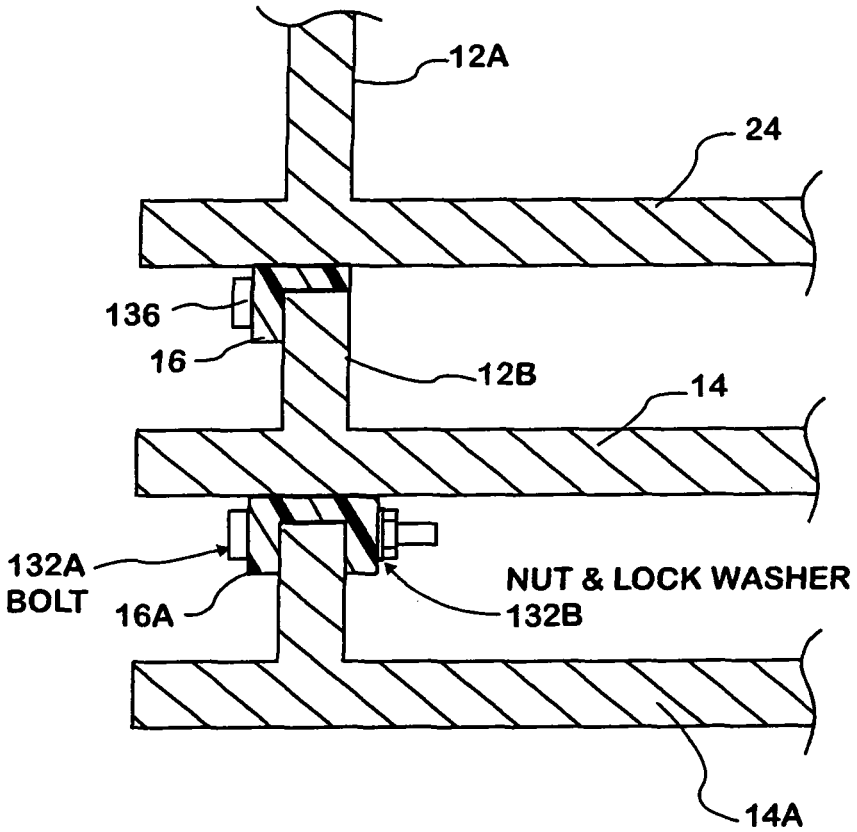
FIG. 13A illustrates a triple bottom tank with a through bolted isolation spacer.

FIG. 13A shows a tank with a triple bottom 24, 14, and 14A. Note that isolator 16 is held in place by a band 136, while the lower isolator is held in place by a through bolt 132A and nut 132B.

FIG. 14 shows how the upper and lower portions of the sidewall 12A and 12B would be separated and isolated by a series of insulating blocks 140.

FIG. 15 shows a specially shaped isolator 146, having an outer leg 148 forming a seal and preventing rain or snow from entering, an upper supporting portion 150, a lower leg 152 and, optionally an inner horizontal leg 154 for holding the isolator upright. If the isolator is constructed without the inner horizontal leg 154, such isolator would hang on the sidewall portion 12B between the portions 146, 148 and 150 of such isolator.

FIG. 16, illustrates that the isolating blocks need not fit only on the sidewall, but could be placed between horizontal outer extensions of the bottoms 24A and 14A. Further, it is within the concept of the present invention in achieving the isolation using various isolating means.

FIG. 17 shows a composite or laminated isolator 160, with an isolating or insulating top 162, and a lower portion 164, which could be of steel or other structural material. The rest of the insulator would be similar to that shown in FIG. 15. The composite concept could also be used with the spacer that is, a block, one portion, say the top of the block being insulating, while the remainder was not. The remainder could be say made of steel. The insulating material portion could be reversed with the non-insulating portion, either on top or bottom or even in between.

FIG. 17A shows another composite spacer similar to that shown in FIG. 17, but with a steel center or element 165, an isolating lower portion or element 167, and a third sealing element 169 on the top. A fourth sealing element 171 (shown in dotted lines) could be provided below or at the bottom if desired. The two sealing elements 169 and 171 could be made of rubber or similar material and used to keep out rain or weather.

Figure 18:
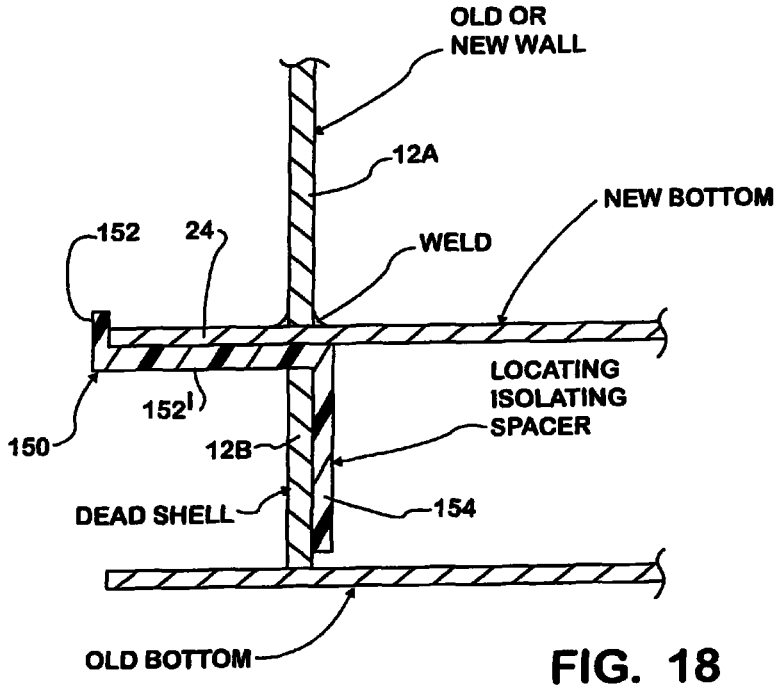
FIG. 18 is a schematic of a tank with a locating spacer.
Figure 18A:
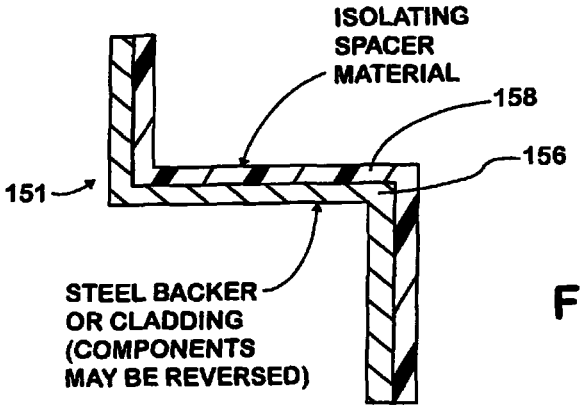
FIG. 18A is a schematic of a spacer like that for use in FIG. 18, but of composite construction with insulating, backing or support portions, and optionally may have one or more sealing portions.

Referring to FIG. 18 another form of spacer is shown which in addition to isolating the top and bottom 12A and 12B from each other, also helps physically locate the upper portion 12A relative to the lower portion 12B and/or the ground. This spacer 150 has an upper vertical leg 152 which is joined to a horizontal leg 152' both engaging the upper or new bottom 24, the horizontal leg 152' connecting to the lower leg 154 paralleling the lower portion 12B. A plurality of three or more spacers 150 on the perimeter of the tank would physically isolate and locate the upper portion of the tank to the lower portion and/or the ground. As shown in FIG. 18A, the spacer 150 can be made of insulating material, like spacer 16 shown in FIG. 1A, 2, 3, etc., or can be of a composite construction like the spacer 151 shown in FIG. 18A, with say a steel portion or element 156 and an insulating portion or element 158. The insulating and non-insulating, say steel, portions could be reversed with the steel and insulating material changing locations. If desired a third or fourth sealing element could also be added above and below to seal to the respective upper and lower tank portions. This type spacer could also or instead, be held in place by adhesives.

Figure 18B:
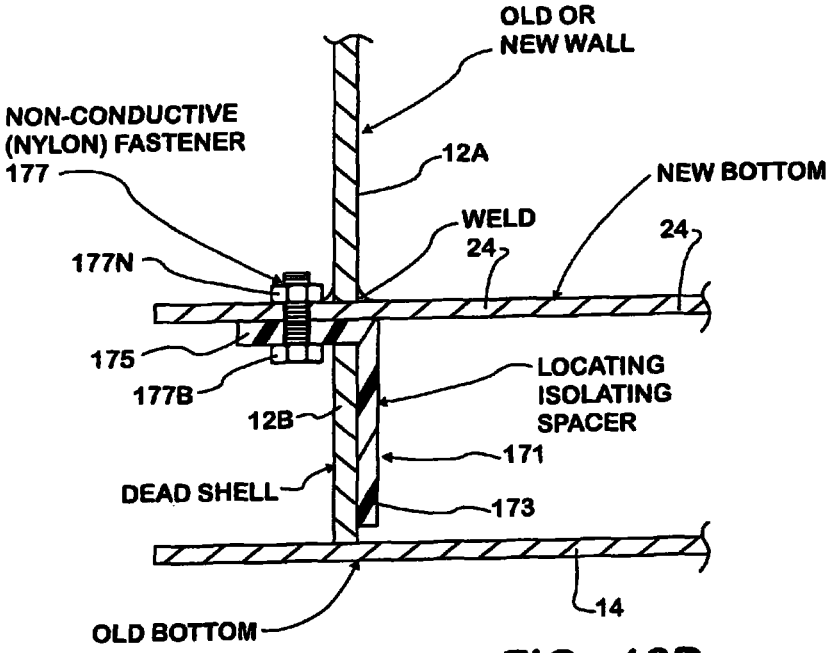
FIG. 18B is a schematic of another form of isolating, locating spacer.

Referring to FIG. 18B a spacer 171 is shown and it has two legs 173 and 175, with the latter being secured to the bottom 24 as by a fastener 177 such as the non-conductive (nylon) nut 177N and bolt 177B shown.

If it is desired to use stronger metal (conductive fasteners—say of steel), they could be isolated by using a non-conductive sleeve and one or more nonconductive washers.

Figure 18C:
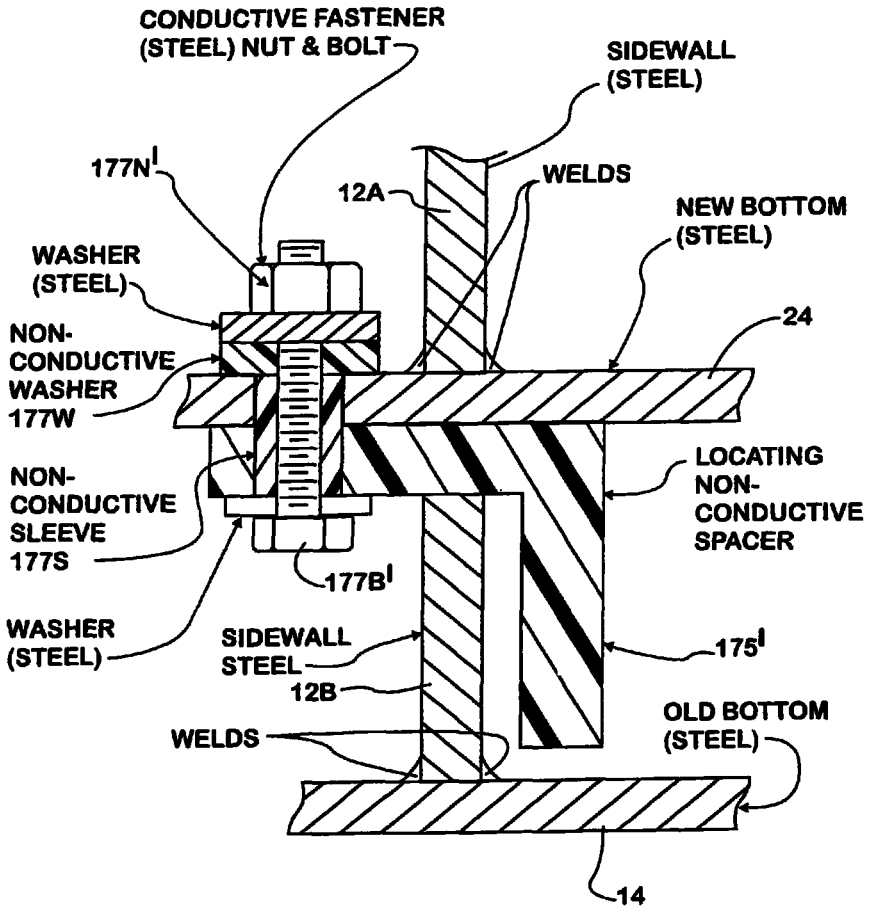
FIG. 18C is a view similar to 18B but enlarged and showing the use of a nonconductive sleeved conductive fastener.

Referring to FIG. 18C, a version similar to that shown in FIG. 18B is illustrated, but instead of a nonconductive fastener, a conductive, say steel, nut 177N' and bolt 177B' are used, and isolated with an insulating sleeve 177S and insulating washer 177W.

Figure 19:
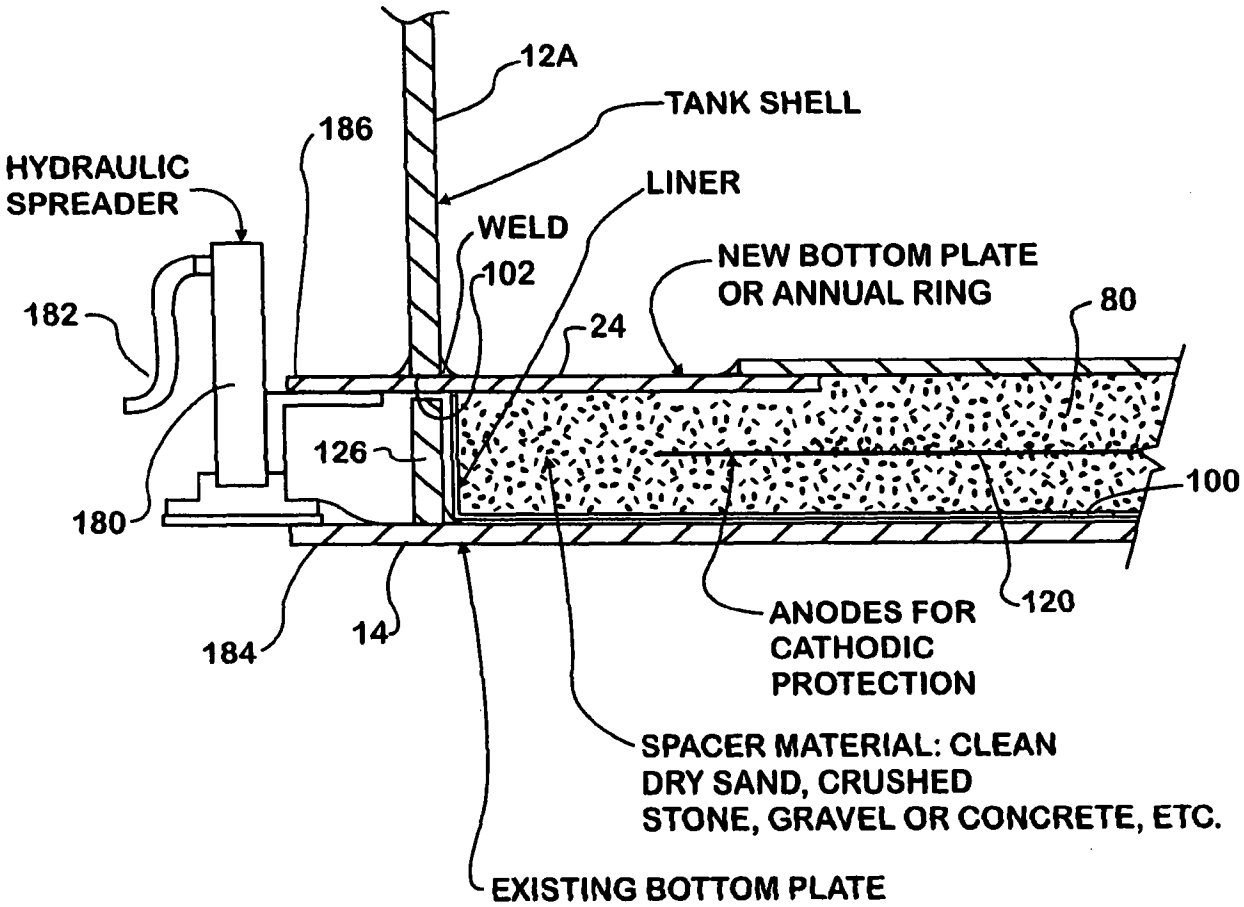
FIG. 19 is a cross-sectional view, similar to FIG. 10, but showing the use of a hydraulic spreader for raising or separating the tank.
Figure 20A:
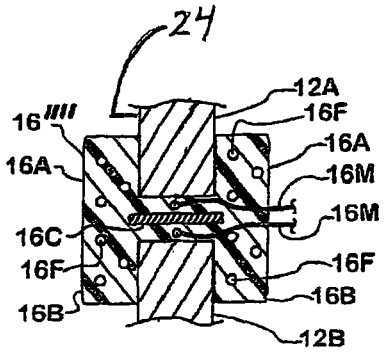
FIGS. 20A and 20B are similar to FIG. 1I and FIG. 1H and also schematically show the new bottom 24.
Figure 20B:
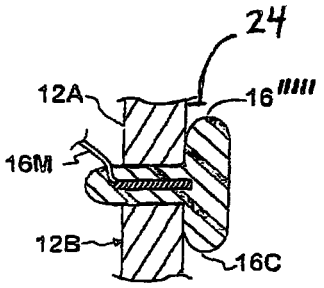

As noted in FIG. 19, the tank portions can be separated by a manual (or even power) operated hydraulic device 180 which has two spreadable jaws or portions 184 and 186 that would move vertically apart to lift or separate the tank portions. The hydraulic cylinder 180 is connected via a hydraulic hose 182 to a manual pump (not shown). Such a device is made by American Rescue Technology, Incorporated and is called a Power Wedge. It can generate a separating force of 20,000 pounds and move a distance 4⅛ inches. Alternatively, a hydraulic service bottle jack of suitable capacity could also be used.

While concrete fill was disclosed, other suitable fills, preferably dry, to provide the desired electrical isolating, insulating high resistive characteristic, could be limestone, granite, fine rocks or gravel, asphalt, sand, pea gravel, clam shells and/or crushed granite, grout, sand/cement grout, stone, and cement. Suitable insulators, insulating block(s), spacer(s), separator(s), and isolator(s), could include rubber, teflon, high density polyethylene (HDPE), fiberglass polyvinyl chloride (PVC), chlorinated polyvinyl chloride (CPVC), low density polyethylene (LDPE), polyethylene plastic, ceramic, nonconductive carbon, air bags, asphalt, non-metallic materials, resins, wood, polyester, isophallic, foam, cinder blocks, bricks, any means for creating a gap, air, jacks, and any other means to prevent electron flow between the new and old bottom. Isolating blocks, spacers, separators or isolators could be formed from any one or more of the above materials. While spacer's or isolator's or block's insulating property is due to the fact it was made or formed to be highly electrically resistant. They, for example, fiberglass (glass and resin), should be compatible with the material or materials being stored or to be stored in the tank to prevent subsequent deterioration over a period of time. For example, some resins might be suitable with say gasoline, while others may not be. Other insulating materials which could be used with or in place of fiberglass are phenolics, non-conductive carbon, non-metallic materials, as long as a non-conductive space, even an air space, is provided between the upper and lower portions of the tank.

Alternatively the reconditioned tank could be separated into the first bottom and the sidewall including the remainder of the tank. In the alternative the spacer would isolate the first bottom from the remainder of the tank. It should be understood, in the reconditioned tank described, the first bottom could be the original tank bottom that previously was in conductive communication with the sidewall and the remainder of the tank.

Within the scope of the invention, it should be understood that a reconstructed tank having cathodic protection could comprise a first bottom of a conductive material which is subject to environmental corrosion. The tank sidewall could include an upper tank sidewall portion comprised of conductive material disposed above a lower tank sidewall portion, with the upper tank sidewall portion spaced from the first bottom so as not to have any low (electrical or no metal to metal contact) resistance contact with the first bottom. To keep the first bottom isolated, at least one high resistivity spacer supported by at least one of the first bottom and lower tank sidewall portion, if any, are provided with the spacer supporting the upper tank sidewall portion such that the upper tank sidewall portion makes no low resistance (metal to metal) contact with the first bottom and/or lower tank sidewall portion, if any. To now retain the contents of the tank a new or second bottom of a conductive material subject to environmental corrosion is provided disposed above the first tank bottom so as not to have any low resistance contact with the first original bottom, the second bottom being supported above the first tank bottom by the high resistivity support (such as insulating block(s) or spacer(s)). The first or old bottom remains in contact and is part of the earth or ground with the new or second bottom electrically isolated from the old bottom.

A cathodic protection system could be provided having at least one negative terminal in conductive communication with the new or second bottom and a positive terminal in conductive communication with an anode, the negative terminal having no low resistance connection to the original or first bottom of the tank. As noted, the reconditioned tank described could have the upper tank sidewall portion supported by the at least one spacer on the lower tank sidewall portion or alternatively on the first bottom itself.

In the reconditioned tank discussed above, the high resistivity support ("no low resistance contact") supporting the second tank bottom comprises sand or other suitable materials disclosed herein. In the reconditioned tank with a cathodic protection system, there is an impressed cathodic protection current with a negative terminal of a rectifier of said system in conductive communication with the second (upper) tank bottom. It should be understood that with the reconditioned tank the anode is a sacrificial anode formed of a material (such as for example, magnesium, zinc, or aluminum) which is more negative in the electromotive series than the conductive material (usually steel) comprising the second tank bottom.

It should be understood that the method of the present invention for cathodically protecting an upper bottom of a multiple-bottom above-ground storage tank could be performed while the tank is in service. The method could comprise the steps of separating the lowest or oldest bottom of the tank or its sidewall at a location below the present or to be installed upper bottom into an upper sidewall portion in conductive communication with the upper bottom and a lower sidewall portion in conductive communication with at least the lower bottom but spaced below the upper bottom, such that there is no low resistivity path or (metal to metal) contact between new bottom and/or the upper sidewall portion and the lower bottom and/or the lower sidewall portion, maintaining the separation of the upper bottom and/or upper sidewall portion from the lower bottom and/or the lower sidewall portion, electrically connecting at least one high resistivity spacer, the upper bottom and/or upper sidewall portion to a negative terminal of a cathodic protection system having a positive terminal connected to at least one anode. By high resistivity and/or no low conductive contact, it is meant a contact of 20 (or greater) to infinite ohms per cm and/or less than 0.05 mhos per cm, or the equivalent of an air gap of 0.001 or 0.1 inches (lower limit) to, say, a practical (upper) limit of 24" (two feet).

Now, the practical limit is not a limitation on the invention, but only that there is no necessity to separate the old bottom from the tank any greater distance and that the cost of doing so may be expensive. Preferably the separator or isolation provides a contact of no less than 22 ohms per cm. As the resistivity of air is several giga ohms per meter for a cm cross section, a very small, but consistent air gap would suffice, say of 0.001 or 0.01 inches or less, but sufficient to give the desired resistance.

A practical way to determine whether the gap or isolation is sufficient would be to test the same using an insulation tester, such as a Model IT, RF/IT or CE/IT made by Tinker & Rasor. If the tester shows insufficient isolation or insulation ("go" or "no go" type reading) then the separator or gap needs to be increased to the point where that tester or the like registers isolation. Copies of descriptions of such testers are attached on pages 22-24 hereto.

The Model RF/IT Insulator Tester is a highly sensitive device, designed to test above-ground pipeline insulators individually to determine their effectiveness. The unit is effective in the testing of pipeline insulators in parallel or series installations even if one or more of the insulators are not operating properly. The tests conducted are fast and accurate, since high resistance shorted insulators are as easy to determine their effectiveness as are the low resistance shorted insulators.

The Tester is equipped with an audible signal circuit, and the tone frequency varies from slow to fast according to resistance across probes. The lower the electrical resistance of the insulator, the faster the frequency of the audible signal. Batteries exchange in seconds through a panel in the access door.

The Tester consists of a portable battery powered electronic instrument with detachable probes for making positive electrical contact across the insulator. The instrument is packaged in a plastic case complete with batteries ready to operate. Two extra steel needle points are supplied with the Tester. The unit is factory calibrated and needs no field adjustments. Calibrations are made with the probe wire conductors supplied with the unit. The model number RF/IT includes the following:

Instrument, complete and ready to operate.

Six AA batteries.

Needle point probes with two extra needles.

Model CE-IT Insulator Tester by Tinker & Rasor is a fully automatic and highly sensitive electronic instrument designed to test the effectiveness of buried pipeline insulators. The CE-IT can also be used to determine isolation condition of pipelines in road crossing casings.

The Model CE-IT circuit automatically adjusts to the voltage polarity present on the underground piping system under test. A direct read out of the test results are displayed in English on the LCD meter. The entire testing procedure is complete in less than 30 seconds and an audible signal alerts the operator when test cycle is completed. Although the Model CE-IT is equipped with power switch, the instrument will automatically shut off in 10 minutes if not in use so as to conserve batteries. The unit is factory calibrated, requires no field adjustments and ready to use.

Features

High density polyethylene instrument case.

Low voltage dot matrix alphanumeric LCD display.

Built-in precision rectifier to eliminate polarity requirement.

Plug-in cable set with clamps.

Hinged instrument panel for quick battery access.

Specifications

Battery: 6 Alkaline "AA" cells.

Dimensions: 8" L×4" W×2¾" H

Operating Weight: 2 lbs.

Shipping Weight: 2 lbs. 4 oz.

Delivery: Fast delivery.

The Model "IT" (Insulator Tester) consists of a magnetic transducer mounted in a single earphone headset with connecting needle point contact probes. The Model "IT" is a "go" or "no go" type tester which operates from low voltage current present on all underground piping systems, thus eliminating the necessity of outside power sources or costly instrumentation and complex connections.

By placing the test probes to metallic surface on either side of the insulator, a distinct audible tone is heard exist if the insulator is performing properly. Absence of a audible tone indicates a faulty insulator. Insulator effectiveness can be determined in less than 10 seconds by lay personnel such as meter readers, service personnel, inspectors, etc.

It should be understood that a reconditioned tank having cathodic protection could comprise: a lower bottom (usually steel) conductive material subject to corrosion, an upper bottom spaced above the lower bottom and also of conductive material (again, usually steel) subject to corrosion, a sidewall (again usually steel) peripheral to the lower and upper bottoms, the sidewall completely separated into an upper sidewall portion in conductive communication with the upper bottom and a lower sidewall portion in conductive communication with the lower bottom, such that there is no low resistance (or metal to metal) path between the upper sidewall portion and the lower sidewall portion, a conductive liner placed on top of the lower bottom, a high resistivity (or no or extremely low conductivity) structural support spacing the conductive liner from the upper bottom, and a negative terminal of a cathodic protection system electrically connected to the upper sidewall portion.

Such a reconditioned tank could use a conductive liner of clay or other suitable material name herein. Such a reconditioned tank could have at least one high resistivity (of a resistivity of 20 to infinite ohms) spacer spacing the upper sidewall portion from the lower bottom and/or lower sidewall portion While several preferred embodiments have been disclosed and described, it should be understood that the equivalent elements and steps fall within the scope of the following claims.

What is claimed is:

1. A method for adding a new bottom to a storage tank having an existing bottom secured to a sidewall of the tank, comprising the steps of:

separating the sidewall into an upper portion above the existing bottom and a lower portion attached to the existing bottom, permanently holding the upper and lower portions of the sidewall spaced apart and the upper portion of the sidewall out of electrical contact with the existing bottom and lower portion of the sidewall, providing a new bottom above the existing bottom and permanently out of electrical contact with the lower portion of the sidewall and the existing bottom, and permanently securing the new bottom to the upper portion of the sidewall permanently out of electrical contact with the lower portion of the sidewall and the existing bottom.

2. A method as in claim 1, wherein the step of separating comprises one or more of:

cutting the tank, lifting the tank, wedging the tank apart, floating the tank, and levering the tank, and the step of holding comprises one or more of holding the tank apart with isolator means, insulator means, spacers, blocks, fill, jacks, legs, a crane, braces, air bags, and gap providing means.

3. The method of claim 2, including the step of:

making the spacers or blocks of one or more of: nonconductive material, high resistance material, fiberglass, non-conductive carbon, neoprene, pneumatic material, teflon, rubber, silicone rubber, wood and plastics.

4. A method as in claim 2, comprising the steps of:
leaving the existing bottom in contact with the ground, and out of metal to metal contact with an upper portion of the tank and new bottom,
optionally removing the center portion of the existing bottom,
said step of separating creating an opening in the tank,
passing material through the opening to form the new bottom,
the further step of: one or more of
providing cathodic protection to the new bottom,
providing lightening protection to the upper portion of the separated tank,
locating the upper portion of the tank relative to the ground and the lower portion of the sidewall and existing bottom, and
providing a conductive liner under the new bottom, whereby
corrosion protection is provided to the new bottom.

5. The method of claim 1, including the steps of:
permitting ionic flow as in an electrolyte to or from the new bottom, but
prohibiting non-ionic electron flow as in metal to metal contact between the new bottom and the existing bottom and the lower portion of the sidewall.

6. A method as in claim 1, comprising the steps of leaving the existing bottom in contact with the ground, and out of metal to metal contact with the new bottom.

7. A method as in claim 1, wherein said existing bottom has a center portion and including the further step of removing the center portion of the existing bottom.

8. The method of claim 1, including the step of providing at least one of a conductive liner under and cathodic protection to the new bottom.

9. The method of claim 1, including the step of providing one or more of lightening protecting to an upper portion of the tank, static charge protection and fault protection.

10. The method of claim 1, comprising the step of containing product in an upper portion of the tank and supporting the tank on a lower portion of the tank in contact with ground, and the step of locating the upper portion of the tank relative to one or more of the ground and existing bottom.

11. The method of claim 1, wherein the step of separating comprises the step of eliminating electrical contact between the upper portion and the existing bottom and a lower portion in contact with the existing bottom and the step of spacing the upper portion of the tank from the lower portion of the tank by generally at least 0.01 inches.

12. The method of claim 1, wherein the step of holding comprises the step of providing one or more of spacers or blocks and making the spacers or blocks of one or more of: electrically nonconductive material, high electrically resistance material, fiberglass, non-conductive carbon, neoprene, pneumatic material, teflons, rubber, silicone rubber, wood and plastics.

13. The method of claim 12, wherein said tank has a perimeter, and including the step of providing one or more of said blocks or spacers on at least a portion of the perimeter of the tank.

14. The method of claim 1, wherein the step of holding comprises the step of providing fill of one or more of highly electrically resistant material, nonconductive material, sand, clay, limestone, granite, crushed granite, fine rocks, gravel, asphalt, pea gravel, clam shells, concrete, air gap and vacuum.

15. The method of claim 1, wherein the step of providing a new bottom comprises the step of providing one or more new bottoms over the existing bottom, and electrically isolating the one or more new bottoms from the existing bottom.

16. The step of claim 1, including the step of providing a conductive liner under the new bottom.

17. The method of claim 1, wherein the tank further comprises at least one support leg, and said step of holding comprising placing a lower portion of the support leg on the ground, electrically isolating the support leg from a lower portion of the tank in contact with the ground and securing the support leg to an upper portion of the tank.

18. The method of claim 1, wherein the steps of separating and holding resulting in a spaced apart gap, further comprising the step of sealing the spaced apart gap between the upper and lower portions of the tank against weather.

19. The method of claim 1, wherein said step of holding the tank spaced apart from and out of electrical contact with the existing bottom comprises the step of temporarily separating to form an opening and then permanently holding the tank spaced apart and out of electrical contact with the existing bottom.

20. A method as in claim 19, wherein the step of providing a new bottom above the existing bottom further comprises the step locating the new bottom above the opening in the tank.

21. A method as in claim 19, wherein the step of securing the new bottom further comprises the step of securing the new bottom above the opening in the tank.

22. The method as in claim 19, wherein said step of separating occurs in the sidewall at the existing bottom or new bottom or between the existing bottom and new bottom.

23. A method for adding a new bottom to a storage tank having an existing bottom secured to a sidewall of the tank, comprising the steps of:
permanently separating the sidewall above and from the existing bottom,
permanently holding the sidewall spaced apart and out of electrical contact with the existing bottom,
providing a new bottom above the existing bottom, and
permanently securing the new bottom to the sidewall,
the step of separating creating an opening in the sidewall of the tank above the existing bottom, passing material through the opening to form the new bottom, and welding the new bottom to the sidewall of the tank above the existing bottom and out of metal to metal contact with the existing bottom.

24. A method as in claim 23, wherein the step of separating comprises the step of one or more of:
cutting the tank, lifting the tank, wedging the tank apart, floating the tank, and levering the tank.

25. A method as in claim 23, wherein the step of holding the sidewall spaced apart from and out of electrical contact with the existing bottom comprises the step of holding the tank apart with one or more of isolator means, insulator means, spacers, blocks, fill, jacks, legs, a crane, braces, air bags, and gap providing means.

26. The method of claim 25, further comprising the step of making the spacers or blocks of one or more of: nonconductive material, high resistance material, fiberglass, nonconductive carbon, neoprene, pneumatic material, teflons, rubber, silicone rubber, wood and plastics.

27. The method of claim 25, further comprising the step of providing fill of one or more of highly electrically resistant material, nonconductive material, sand, clay, limestone, granite, crushed granite, fine rocks, gravel, asphalt, pea gravel, clam shells, concrete, air gap and vacuum.

28. The method of claim 25, wherein said tank has a perimeter, and including the step of providing one or more of said blocks or spacers on at least a portion of the perimeter of the tank.

29. A method as in claim 23, comprising the steps of leaving the existing bottom in contact with the ground, and out of metal to metal contact with the new bottom.

30. A method as in claim 23, wherein said existing tank bottom has a center portion and including the further step of removing the center portion of the existing bottom.

31. A method as in claim 23, wherein the step of separating includes the step of separating the sidewall into upper and lower portions.

32. The method of claim 23, including the step of providing cathodic protection to the new bottom.

33. The method of claim 23, including the step of providing one or more of:

a conductive liner under the new bottom, lightening protecting to an upper portion of the tank, static charge protection and fault protection.

34. The method of claim 23, wherein the step of separating comprises the step of providing an upper portion of the tank for containing product and a lower portion of the tank in contact with ground, and the step of locating the upper portion of the separated tank relative to one or more of the ground and existing bottom.

35. The method of claim 23, wherein the step of separating comprises the step of separating the tank into an upper portion without contact with the existing bottom and a lower portion in contact with the existing bottom and the step of spacing the upper portion of the tank from the lower portion of the tank by at least 0.01 inches.

36. The method of claim 23, wherein the step of providing a new bottom comprises the step of providing one or more new bottoms over the existing bottom, and electrically isolating the one or more new bottoms from the existing bottom.

37. The step of claim 23, including the step of providing a conductive liner under the new bottom.

38. The method of claim 23, permitting ionic flow as in an electrolyte to or from the new bottom, but prohibiting non-ionic electron flow as in metal to metal contact between the new bottom and the existing bottom.

39. The method of claim 23 wherein the tank further comprises at least one support leg, and said step of holding comprising placing a lower portion of the support leg on the ground, electrically isolating the support leg position from a lower portion the tank in contact with the ground and securing the upper portion of the support leg to an upper portion of the tank.

40. The method of claim 23, wherein the step of separating and holding results in a spaced apart gap, further comprising the step of sealing the spaced apart gap between the upper and lower portions of the tank against weather.

41. The method of claim 23, wherein said step of holding the tank spaced apart from and out of electrical contact with the existing bottom comprises the step of temporarily separating to form an opening and then permanently holding the tank spaced apart and out of electrical contact with the existing bottom.

42. A method as in claim 41, wherein the step of providing a new bottom above the existing bottom further comprises the step of locating the new bottom above the opening in the tank.

43. A method as in claim 23, wherein the step of securing the new bottom further comprises the step of securing the new bottom above the opening in the tank.

44. The method as in claim 23, wherein said step of separating occurs in the sidewall at least at one of (1) the existing bottom (2) new bottom and (3) between the existing bottom and new bottom.

* * * * *